US009738293B2

(12) United States Patent
Williamson et al.

(10) Patent No.: US 9,738,293 B2
(45) Date of Patent: Aug. 22, 2017

(54) ADJUSTABLE RAILWAY WAYSIDE SIGNAL STRUCTURE

(71) Applicant: Siemens Industry, Inc., Alpharetta, GA (US)

(72) Inventors: Carrie Williamson, Eddyville, KY (US); Leonard Wydotis, Louisville, KY (US)

(73) Assignee: Siemens Industry, Inc., Alpharetta, GA (US)

( * ) Notice: Subject to any disclaimer, the term of this patent is extended or adjusted under 35 U.S.C. 154(b) by 470 days.

(21) Appl. No.: 14/516,073

(22) Filed: Oct. 16, 2014

(65) Prior Publication Data

US 2015/0344049 A1 Dec. 3, 2015

Related U.S. Application Data

(60) Provisional application No. 62/004,487, filed on May 29, 2014.

(51) Int. Cl.
*B61L 23/00* (2006.01)
*B61L 5/18* (2006.01)

(52) U.S. Cl.
CPC ..... *B61L 23/00* (2013.01); *B61L 5/1863* (2013.01)

(58) Field of Classification Search
CPC ..... B61L 23/00; B61L 15/1863
USPC ..... 246/473 R
See application file for complete search history.

(56) References Cited

U.S. PATENT DOCUMENTS 1,591,399 A * 7/1926 Nickell ..... B61L 5/125 246/477
3,952,978 A * 4/1976 Reinitz ..... B61L 29/24 238/10 R
4,073,453 A * 2/1978 Thomas ..... B61L 29/24 246/125
5,433,166 A * 7/1995 Donatello ..... B61L 5/1836 116/202
5,746,036 A * 5/1998 Angelette ..... E02D 27/42 249/163
6,006,861 A * 12/1999 Clinton ..... E01F 13/06 182/97
6,189,839 B1 * 2/2001 Lemieux ..... E01F 13/048 246/127
6,435,459 B1 * 8/2002 Sanderson ..... B61L 5/1827 246/473.3
6,474,605 B1 * 11/2002 Wydotis ..... B61L 5/107 246/220
6,663,052 B1 * 12/2003 Brushwood ..... B61L 5/10 246/220

(Continued)

FOREIGN PATENT DOCUMENTS

GB 200716 A 7/1923

OTHER PUBLICATIONS

PCT International Search Report dated Oct. 30, 2015 corresponding to PCT International Application No. PCT/US2015/042458 filed Jul. 28, 2015 (11 pages).

*Primary Examiner* — Jason C Smith

(57) ABSTRACT

An adjustable mount for a light signal assembly may comprise a fixture and a mounting track. The fixture may be configured to be attached to the light signal assembly. The mounting track may be configured to allow the fixture to be adjustably positioned in a direction substantially parallel to a length of a cantilever or bridge and mounted to the mounting track.

31 Claims, 9 Drawing Sheets

(56) References Cited

U.S. PATENT DOCUMENTS

| | | | | |
|---|---|---|---|---|
| 6,683,540 | B1 * | 1/2004 | Harrison | B61L 29/24 116/63 R |
| 6,714,140 | B2 * | 3/2004 | Eguiluz Fernandez | B61L 15/02 340/463 |
| 2006/0251454 | A1 * | 11/2006 | Ashton | B61L 5/1863 400/1 |
| 2016/0108590 | A1 * | 4/2016 | Wydotis | B61L 5/1872 362/430 |

* cited by examiner

ADJUSTABLE RAILWAY WAYSIDE SIGNAL STRUCTURE

BACKGROUND

Railroads often use wayside signal cantilevers to mount light signals (e.g., red/yellow/green signals) in locations where there are multiple parallel tracks and the signals cannot be mounted on masts due to lateral clearance restrictions between the track centers. The position of each signal with respect to the associated track is safety critical to ensure locomotive engineers always know which signals apply to their tracks. Cantilevers allow the signals to be mounted over the tracks, therefore eliminating lateral clearance issues on the sides of each track while allowing the signals to be correlated with each track to avoid confusion. In some situations, for example when the number of parallel tracks or the distance between tracks is too great to allow for a stable cantilever structure, a bridge structure may be used with vertical supports on both sides of the tracks.

FIG. 1A is a railway wayside signal cantilever structure 100. The structure 100 includes a support 110 and cantilever 120 extending over two tracks 10, 11. Two sets of light signals 150, 151 are mounted on the cantilever 120, one for each track 10, 11. The structure 100 may include a ladder 115 and walkway 125 to allow maintenance access to the light signals 150, 151. Light signals 150, 151 may be present on multiple levels (two are shown in FIG. 1A), each with a walkway 125. In this example, light signals 150, 151 are positioned 3-4 feet from the centers of their associated tracks 10, 11. A train operator can thus easily tell which light signal 150, 151 corresponds to which track 10, 11.

FIG. 1B is a railway wayside signal bridge structure 1000. The structure 1000 includes a pair of supports 1010, 1011 and bridge 1020 extending over four tracks 12, 13, 14, 15. Four sets of light signals 1050, 1051, 1052, 1053 are mounted on the bridge 1020, one for each track 12, 13, 14, 15. The structure 1000 may include a ladder 1015 and walkway 1025 to allow maintenance access to the light signals 1050, 1051, 1052, 1053. Light signals 1050, 1051, 1052, 1053 may be present on multiple levels (two are shown in FIG. 1B), each with a walkway 1025. In this example, light signals 1050, 1051, 1052, 1053 are positioned 3-4 feet from the centers of their associated tracks 12, 13, 14, 15. A train operator can thus easily tell which light signal 1050, 1051, 1052, 1053 corresponds to which track 12, 13, 14, 15.

The distance between adjacent tracks may vary among locations due to environmental variables such as landscaping and space restrictions. As a result, the positions of cantilever or bridge mounted overhead signals may vary among locations, and cantilevers and bridges are designed and configured in the factory to work in the specific location in which they are to be installed.

BRIEF DESCRIPTIONS OF THE DRAWINGS

DETAILED DESCRIPTION OF SEVERAL EMBODIMENTS

Systems and methods described herein may provide cantilevered or bridged railroad light signals that are adjustable in accordance with track center variations in the field. One or more light signals may be adjusted laterally along the length of a cantilever arm or bridge so that the signals can be positioned in track center positions corresponding to actual track positions. Adjustments may be made prior to installation, for example. Thus, one cantilever or bridge configuration may be used for any location having multiple parallel tracks.

Figure 1A:
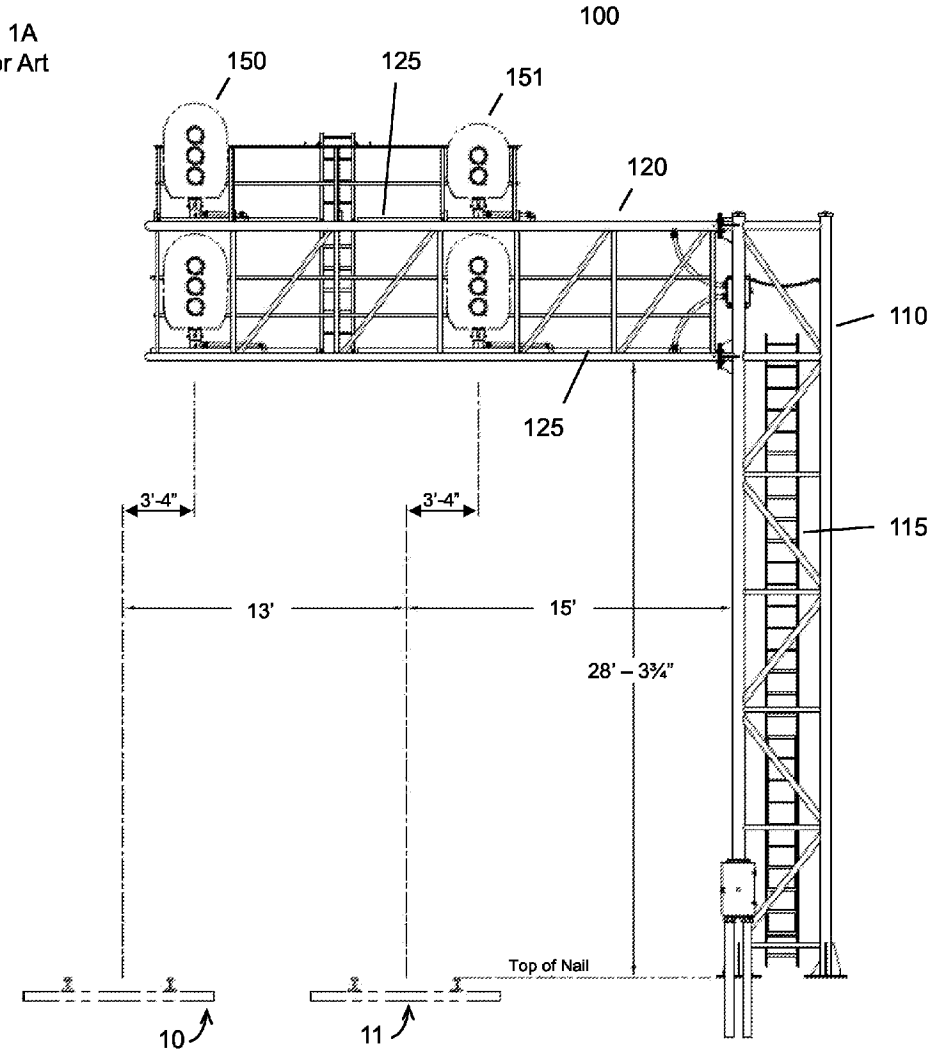
Fig. 1A Prior Art
FIG. 1A is a railway wayside signal cantilever structure.
Figure 1B:
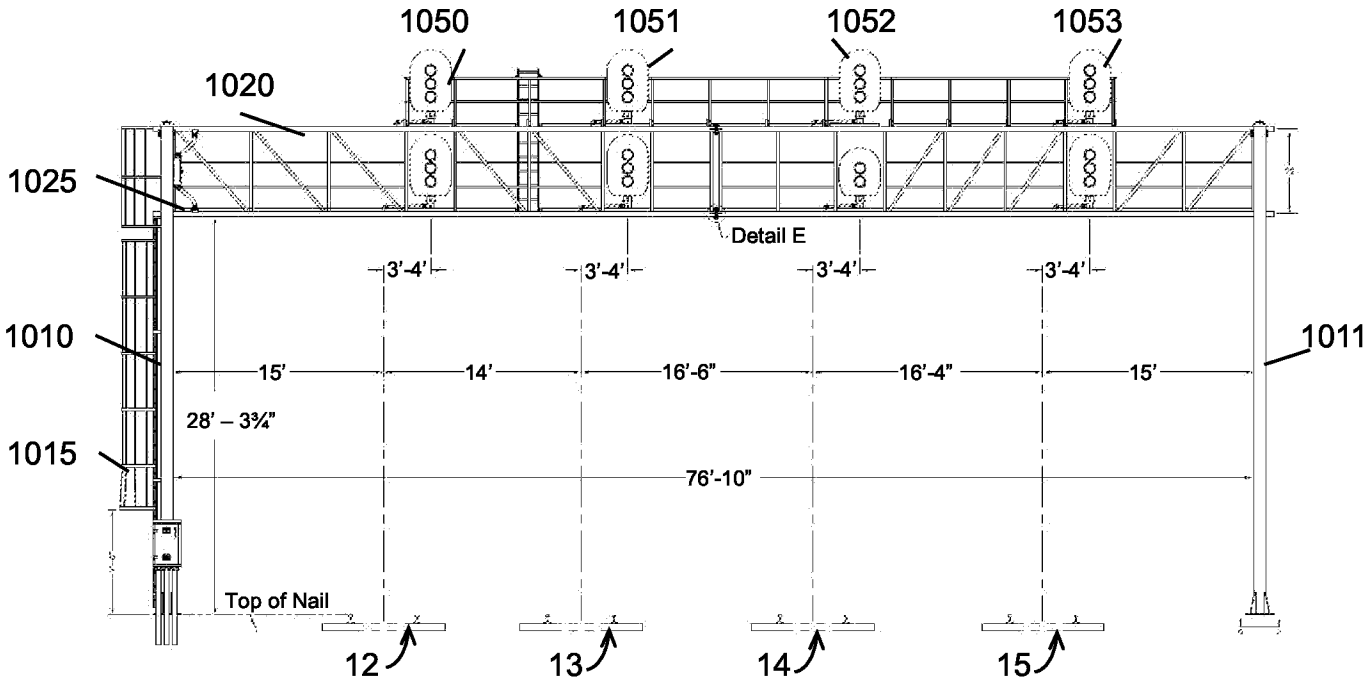
Fig. 1B Prior Art
FIG. 1B is a railway wayside signal bridge structure.
Figure 2:
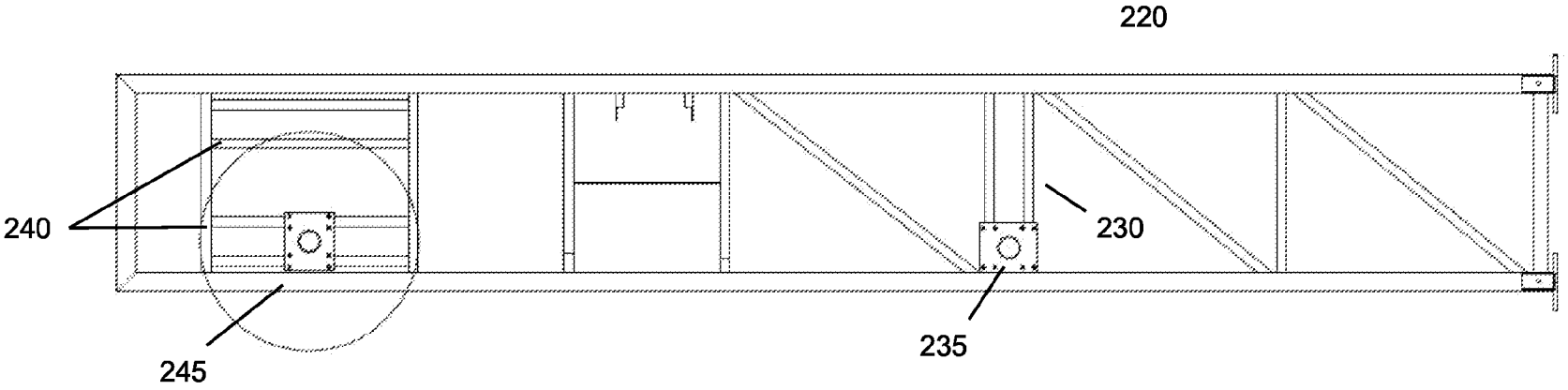
FIG. 2 is a top view of a cantilever according to an embodiment of the invention.

FIG. 2 is a top view of a cantilever 220 according to an embodiment of the invention. The cantilever 220 may be installed on a railway wayside signal cantilever support, for example on the support 110 instead of the cantilever 120 shown in FIG. 1. The cantilever 220 may include a walkway (not shown), which may be similar to the walkway of the cantilever 120 of FIG. 1. The cantilever 220 may include mounts for light signals. The cantilever 220 may include fixed mounts 235, adjustable mounts 245, or a combination thereof. In this example, one fixed mount 235 and one adjustable mount 245 is provided, although any number and combination of mounts may be provided in other embodiments. An example fixed mount 235 is shown in greater detail in FIG. 3, and an example adjustable mount 245 is shown in greater detail in FIG. 4. The cantilever 220 may include a plurality of structural elements, such as pipes 230 perpendicular to the length of the cantilever 220 and pipes 240 parallel to the length of the cantilever 220. Fixed mounts 235 may be mounted to the perpendicular pipes 230, and adjustable mounts 245 may be mounted to the parallel pipes 240. The parallel pipes 240 may form a mounting track along which an adjustable mount 245 may be positioned and attached. Other mounting tracks (e.g., a bar, a grooved surface, etc.) may also be used in some embodiments.

Figure 3:
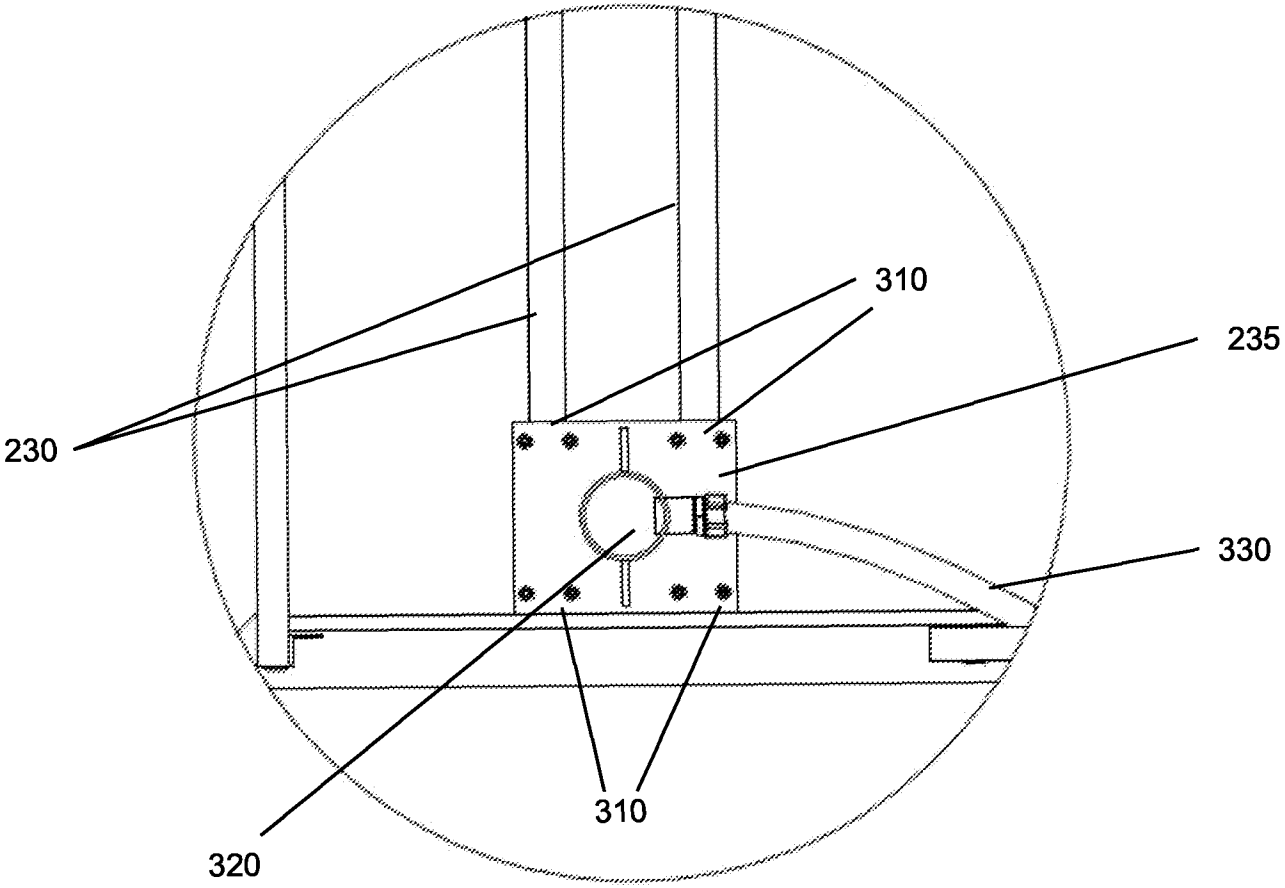
FIG. 3 is a fixed mount according to an embodiment of the invention.

FIG. 3 is a fixed mount 235 according to an embodiment of the invention. The fixed mount 235 may be attached to the perpendicular pipes 230 via mounting hardware 310. For example, U-bolts may be used as mounting hardware 310, although other hardware may be used in some embodiments. The fixed mount 235 may include a fixture 320 to which a light signal assembly (not shown) may be mounted. The fixed mount 235 may accept wiring 330 for power and control of the light signal assembly. Because the fixed mount 235 is mounted to perpendicular pipes 230, it cannot be moved laterally. Thus, if one or more fixed mounts 235 are provided on a cantilever 220, they may be positioned on perpendicular pipes 230 which are disposed above a track (or above and offset from the track, as in FIG. 1).

Figure 4:
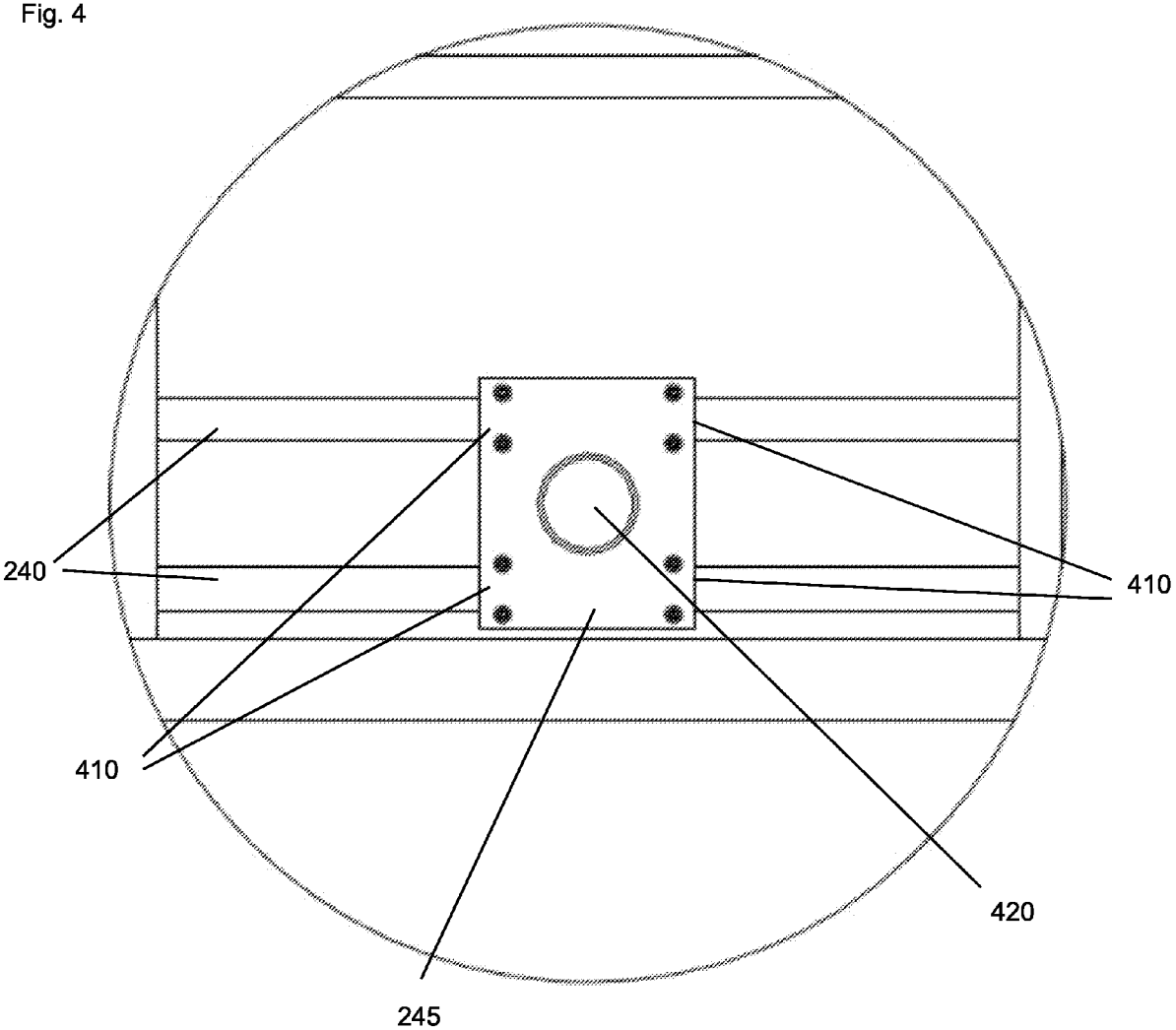
FIG. 4 is an adjustable mount according to an embodiment of the invention.

FIG. 4 is an adjustable mount 245 according to an embodiment of the invention. The adjustable mount 245 may be attached to the parallel pipes 240 via mounting hardware 410. For example, U-bolts may be used as mounting hardware 410, although other hardware may be used in some embodiments. The adjustable mount 245 may include a fixture 420 to which a light signal assembly (not shown) may be mounted. The adjustable mount 245 may accept wiring for power and control of the light signal assembly (not shown) like the fixed mount 235. Because the adjustable mount 245 is mounted to parallel pipes 240, it can be moved laterally. The parallel pipes 240 may serve as a mounting track for the adjustable mount 245. While parallel pipes 240 are shown in FIG. 4, any mounting track that allows the adjustable mount 245 to be moved substantially parallel to the length of the cantilever 220 may be used. The adjustable mount 245 may be positioned above a track (or above and offset from the track, as in FIG. 1) and fixed in place with mounting hardware 410. The adjustable mount 245 may have a range of adjustment sufficient to allow a suitable level of flexibility to account for variations in track positioning. For example, a 36 inch lateral adjustability may be provided, although other ranges are possible.

Figure 5:
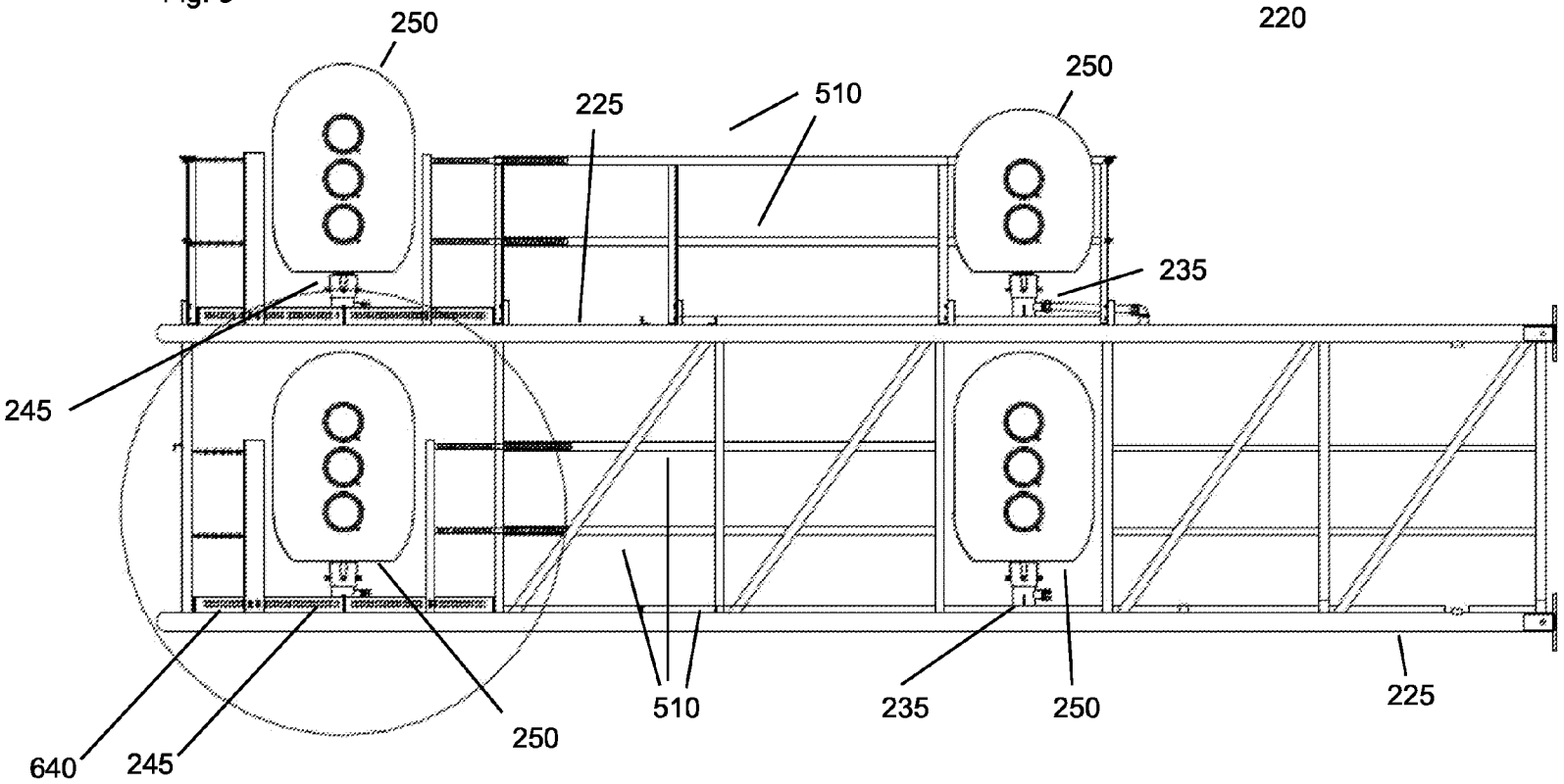
FIG. 5 is a front view of a cantilever according to an embodiment of the invention.

FIG. 5 is a front view of a cantilever 220 according to an embodiment of the invention. The front view may represent a view of the cantilever 220 from an approaching train, so that the light signal assemblies 250 face forward, as shown. The light signal assemblies 250 may be mounted in the fixed mounts 235 and/or adjustable mounts 245. As in the cantilever 120 of FIG. 1A, a walkway 225 may be provided for each level on which light signal assemblies 250 are present. Handrails 510 may be provided along each walkway 225. Pipes 230, 240 (not shown) may be disposed behind one or more of the handrails 510 and/or a toe board 640 (described with respect to FIG. 6 below) in this view.

Figure 6:
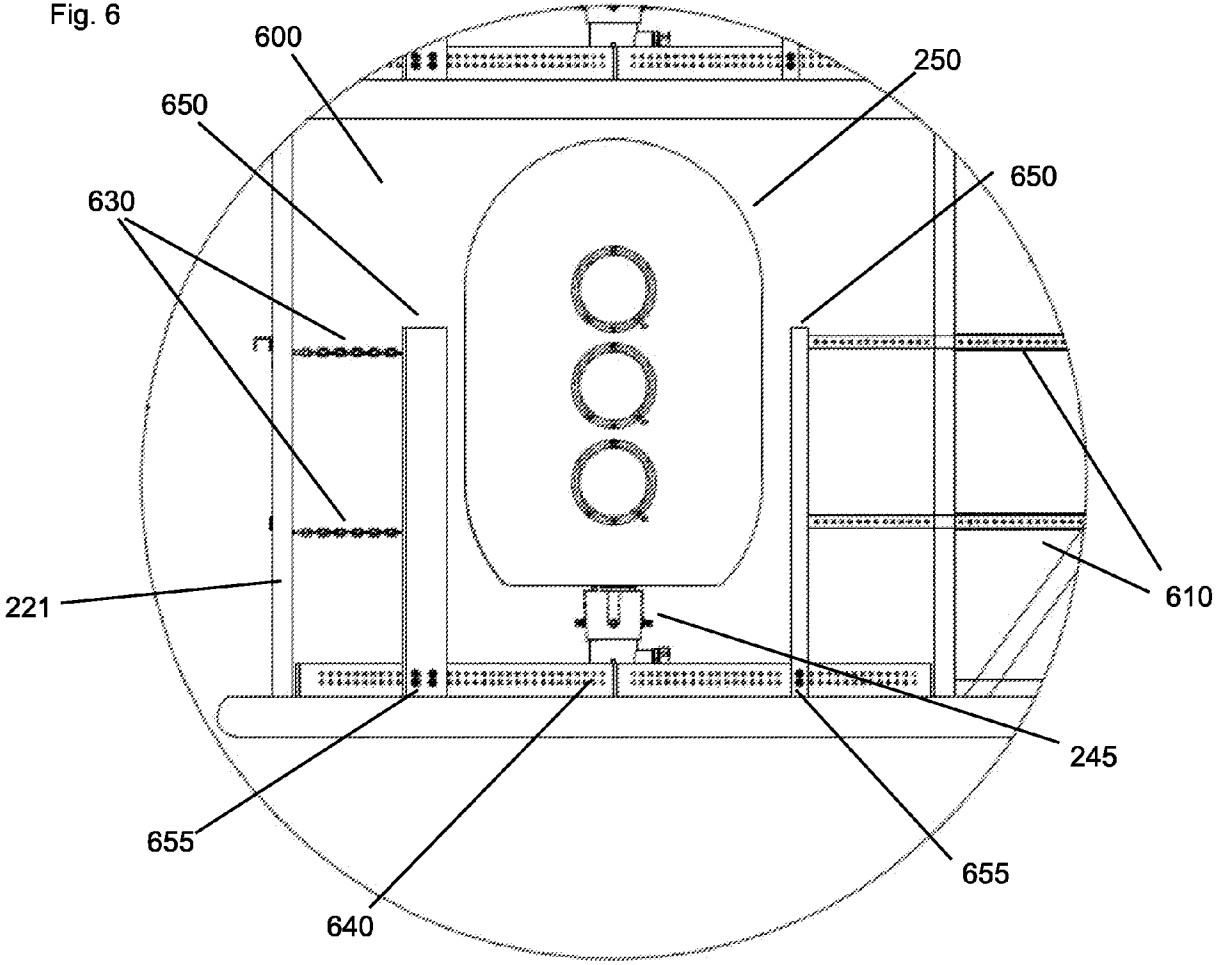
FIG. 6 is a cantilever and light signal according to an embodiment of the invention.

FIG. 6 is a cantilever 220 and light signal 250 according to an embodiment of the invention. In this example, the light signal 250 is mounted to an adjustable mount 245. Because the mount 245 is laterally adjustable, a space 600 without handrails 510 may be provided to accommodate the light signal 250 throughout the entire range of adjustment. To provide protection for the walkway 225 in the space 600, adjustable handrails 610 and/or chains 630 and a toe board 640 may be used. The toe board 640 may be attached to the cantilever 220 (e.g., by bolting or welding) and may include a plurality of holes. The parallel pipes 240 (not shown) may be disposed behind the toe board 640 in this view.

In an embodiment wherein one side of the space 600 is adjacent to an end side of the cantilever 220, one or more chains 630 may attach at one end to a vertical support 221 of the cantilever 220. The other end of the chains 630 may be attached to an adjustable handrail upright 650. The adjustable handrail upright 650 may be slid along the toe board 640 and mounted to the toe board 640 using mounting hardware 655 inserted into one or more of the plurality of holes in the toe board 640. Thus, the adjustable handrail upright 650 and chains 630 may be disposed close enough to the light signal 250 to provide fall protection for the walkway 225.

One or more adjustable handrail assemblies 610 may be provided on the side of the space 600 not adjacent to an end side of the cantilever 220. In embodiments wherein the space 600 is not adjacent to an end side of the cantilever 220, adjustable handrail assemblies 610 may be provided on both sides of the space 600. The adjustable handrail assemblies 610 may include, for example, flat bars and U channels including holes and mounting hardware. The flat bars may be slid within the U channels and fastened together in place with the holes and mounting hardware. One end of each adjustable handrail assembly 610 may be attached to an adjustable handrail upright 650. The adjustable handrail upright 650 may be slid along the toe board 640 and mounted to the toe board 640 using mounting hardware 655 inserted into one or more of the plurality of holes in the toe board 640. Thus, the adjustable handrail upright 650 and adjustable handrail assembly 610 may be disposed close enough to the light signal 250 to provide fall protection for the walkway 225.

Figure 7:
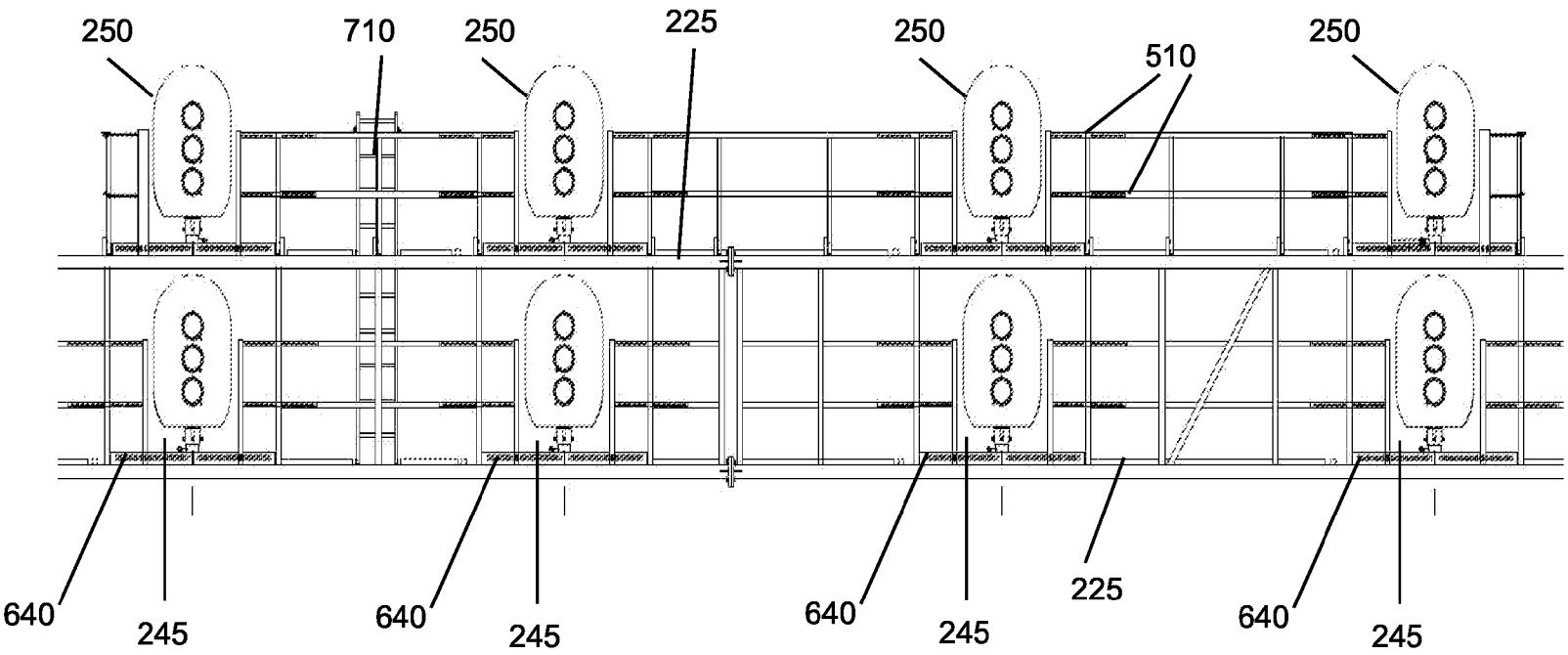
FIG. 7 is a front view of a bridge according to an embodiment of the invention.
Figure 8:
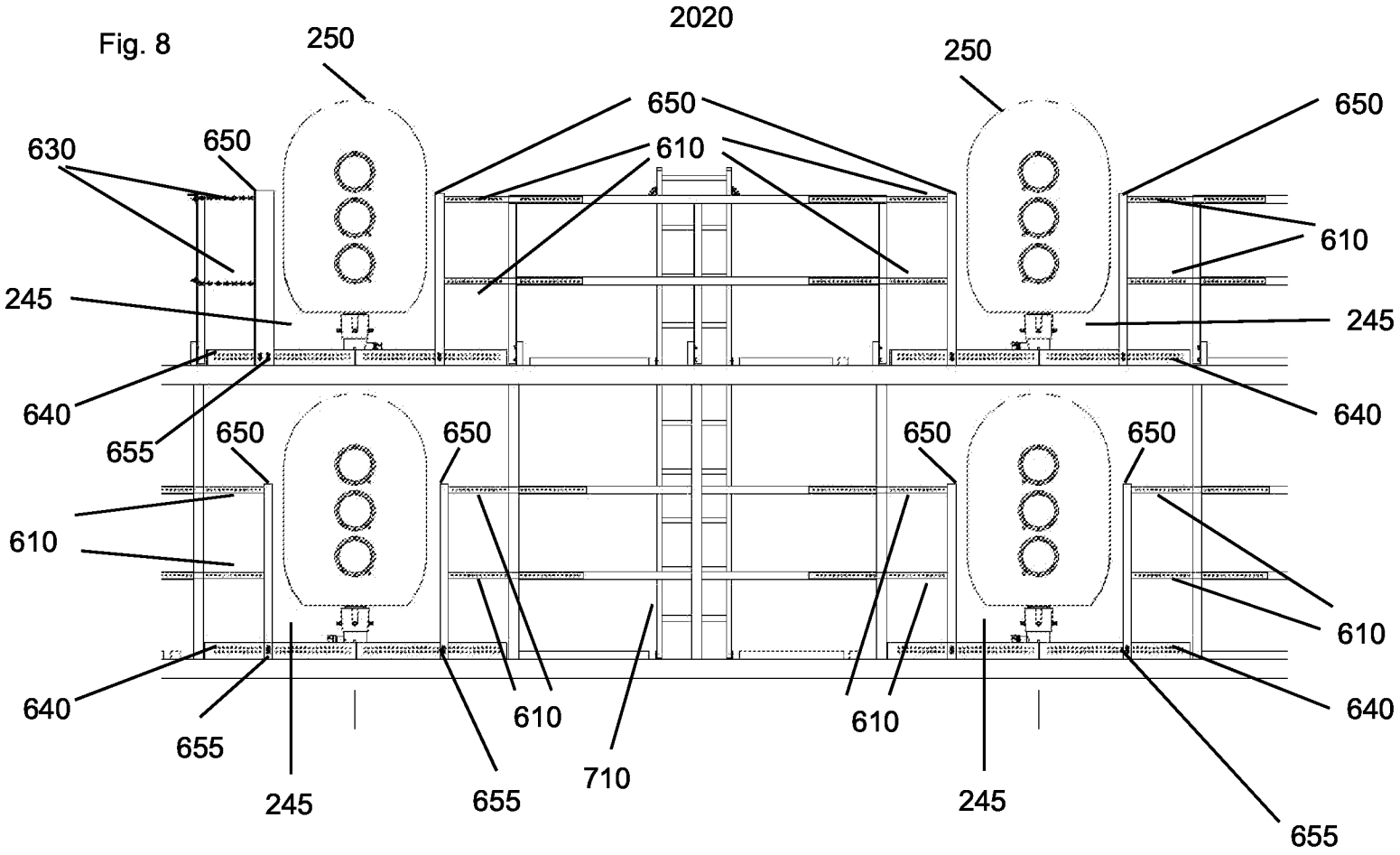
FIG. 8 is a front view of a bridge according to an embodiment of the invention.

FIGS. 7 and 8 are front views of a bridge 2020 according to an embodiment of the invention. The front view may represent a view of the bridge 2020 from an approaching train, so that the light signal assemblies 250 face forward, as shown. The light signal assemblies 250 may be mounted in the fixed mounts 235 and/or adjustable mounts 245. In FIGS. 7 and 8, each light signal 250 is mounted to an adjustable mount 245, although the bridge 2020 may also use fixed mounts 235 like those shown in the cantilever example of FIG. 5. As in the bridge 1020 of FIG. 1B, a walkway 225 may be provided for each level on which light signal assemblies 250 are present. One or more ladders 710 may be provided to allow users to move between levels of the bridge 2020. Handrails 510 may be provided along each walkway 225. Pipes 230, 240 (not shown) may be disposed behind one or more of the handrails 510 and/or a toe board 640. Because the mount 245 is laterally adjustable, a space 600 without handrails 510 may be provided to accommodate the light signal 250 throughout the entire range of adjustment. To provide protection for the walkway 225 in the space 600, adjustable handrails 610 and/or chains 630 and a toe board 640 may be used. The toe board 640 may be attached to the cantilever 220 (e.g., by bolting or welding) and may include a plurality of holes. The parallel pipes 240 (not shown) may be disposed behind the toe board 640 in this view.

As with the cantilever 220, one or more chains 630 may attach at one end to a vertical support 221 of the bridge 2020 for mounts 245 wherein one side of the space 600 is adjacent to an end side of the bridge 2020. The other end of the chains 630 may be attached to an adjustable handrail upright 650. The adjustable handrail upright 650 may be slid along the toe board 640 and mounted to the toe board 640 using mounting hardware 655 inserted into one or more of the plurality of holes in the toe board 640. Thus, the adjustable handrail upright 650 and chains 630 may be disposed close enough to the light signal 250 to provide fall protection for the walkway 225.

One or more adjustable handrail assemblies 610 may be provided on the side of the space 600 not adjacent to an end side of the bridge 2020. For mounts 245 wherein both sides of the space 600 are not adjacent to an end side of the bridge 2020 (i.e., interior mounts 245), adjustable handrail assemblies 610 may be provided on both sides of the space 600. The adjustable handrail assemblies 610 may include, for example, flat bars and U channels including holes and mounting hardware. The flat bars may be slid within the U channels and fastened together in place with the holes and mounting hardware. One end of each adjustable handrail assembly 610 may be attached to an adjustable handrail upright 650. The adjustable handrail upright 650 may be slid along the toe board 640 and mounted to the toe board 640 using mounting hardware 655 inserted into one or more of the plurality of holes in the toe board 640. Thus, the adjustable handrail upright 650 and adjustable handrail assembly 610 may be disposed close enough to the light signal 250 to provide fall protection for the walkway 225.

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s)

how to implement alternative embodiments. Thus, the present embodiments should not be limited by any of the above-described embodiments In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112, paragraph 6. Claims that do not expressly include the phrase "means for" or "step for" are not to be interpreted under 35 U.S.C. 112, paragraph 6.

What is claimed is:

1. An adjustable mount for a light signal assembly comprising:

a fixture configured to be attached to the light signal assembly; and a mounting track configured to allow the fixture to be adjustably positioned in a direction substantially parallel to a length of a cantilever or bridge and mounted to the mounting track, the mounting track comprising a plurality of parallel mounting elements, wherein the fixture comprises mounting hardware configured to couple the fixture to at least two of the plurality of parallel mounting elements.

2. The adjustable mount of claim 1, wherein the fixture is further configured to accept wiring for the light signal assembly.

3. The adjustable mount of claim 1, wherein the plurality of parallel mounting elements comprises at least two pipes whose lengths are substantially parallel to the length of the cantilever or bridge.

4. The adjustable mount of claim 1, further comprising a toe board configured to be attached to one or more adjustable handrail uprights.

5. The adjustable mount of claim 4, wherein the toe board comprises a plurality of holes allowing the one or more adjustable handrail uprights to be adjustably positioned in the direction substantially parallel to the length of the cantilever or bridge and mounted to the toe board with mounting hardware.

6. A railway wayside cantilever structure comprising:

a vertical support, a cantilever mounted to the vertical support at a first end; and at least one adjustable mount for a light signal assembly comprising:

a fixture configured to be attached to the light signal assembly; and a mounting track configured to allow the fixture to be adjustably positioned in a direction substantially parallel to a length of the cantilever and mounted to the mounting track, the mounting track being connected to the cantilever, the mounting track comprising a plurality of parallel mounting elements, wherein the fixture comprises mounting hardware configured to couple the fixture to at least two of the plurality of parallel mounting elements.

7. The cantilever structure of claim 6, wherein the fixture is further configured to accept wiring for the light signal assembly.

8. The cantilever structure of claim 6, wherein the plurality of parallel mounting elements comprises at least two pipes whose lengths are substantially parallel to the length of the cantilever.

9. The cantilever structure of claim 6, further comprising a toe board configured to be attached to one or more adjustable handrail uprights.

10. The cantilever structure of claim 9, wherein the toe board comprises a plurality of holes allowing the one or more adjustable handrail uprights to be adjustably positioned in the direction substantially parallel to the length of the cantilever and mounted to the toe board with mounting hardware.

11. The cantilever structure of claim 9, further comprising one or more chains attached to at least one of the one or more adjustable handrail uprights and a second end of the cantilever opposite the first end.

12. The cantilever structure of claim 9, further comprising one or more handrails each comprising a fixed portion and an adjustable portion, wherein each adjustable portion of each handrail is attached to one of the one or more adjustable handrail uprights.

13. The cantilever structure of claim 12, wherein each adjustable portion of each handrail comprises a flat bar, a U channel configured to accept the flat bar, and mounting hardware configured to attach the flat bar to the U channel.

14. The cantilever structure of claim 6, further comprising one or more handrails.

15. The cantilever structure of claim 6, further comprising one or more walkways.

16. The cantilever structure of claim 6, further comprising at least one light signal assembly, each light signal assembly being mounted to one of the at least one adjustable mounts.

17. The cantilever structure of claim 6, further comprising at least one fixed mount for a light signal assembly.

18. The cantilever structure of claim 17, further comprising at least one light signal assembly, each light signal assembly being mounted to one of the at least one adjustable mounts or one of the at least one fixed mounts.

19. A railway wayside bridge structure comprising:

a pair of vertical supports, a bridge mounted to a first one of the vertical supports at a first end and a second one of the vertical supports at a second end; and at least one adjustable mount for a light signal assembly comprising:

a fixture configured to be attached to the light signal assembly; and a mounting track configured to allow the fixture to be adjustably positioned in a direction substantially parallel to a length of the bridge and mounted to the mounting track, the mounting track being connected to the bridge, the mounting track comprising a plurality of parallel mounting elements, wherein the fixture comprises mounting hardware configured to couple the fixture to at least two of the plurality of parallel mounting elements.

20. The bridge structure of claim 19, wherein the fixture is further configured to accept wiring for the light signal assembly.

21. The bridge structure of claim 19, wherein the plurality of parallel mounting elements comprises at least two pipes whose lengths are substantially parallel to the length of the bridge.

22. The bridge structure of claim 19, further comprising a toe board configured to be attached to one or more adjustable handrail uprights.

23. The bridge structure of claim 22, wherein the toe board comprises a plurality of holes allowing the one or more adjustable handrail uprights to be adjustably positioned in the direction substantially parallel to the length of the bridge and mounted to the toe board with mounting hardware.

24. The bridge structure of claim 22, further comprising one or more chains attached to at least one of the one or more adjustable handrail uprights and a second end of the bridge opposite the first end.

25. The bridge structure of claim 22, further comprising one or more handrails each comprising a fixed portion and an adjustable portion, wherein each adjustable portion of each handrail is attached to one of the one or more adjustable handrail uprights.

26. The bridge structure of claim 25, wherein each adjustable portion of each handrail comprises a flat bar, a U channel configured to accept the flat bar, and mounting hardware configured to attach the flat bar to the U channel.

27. The bridge structure of claim 19, further comprising one or more handrails.

28. The bridge structure of claim 19, further comprising one or more walkways.

29. The bridge structure of claim 19, further comprising at least one light signal assembly, each light signal assembly being mounted to one of the at least one adjustable mounts.

30. The bridge structure of claim 19, further comprising at least one fixed mount for a light signal assembly.

31. The bridge structure of claim 30, further comprising at least one light signal assembly, each light signal assembly being mounted to one of the at least one adjustable mounts or one of the at least one fixed mounts.

* * * * *